US011375785B2

(12) United States Patent
Tsai et al.

(10) Patent No.: US 11,375,785 B2
(45) Date of Patent: Jul. 5, 2022

(54) SUITCASE FOR TRANSPORTING BOTTLES

(71) Applicant: PRIMA USA TRAVEL INC, Commerce, CA (US)

(72) Inventors: Kevin Tsai, Commerce, CA (US); Nelson Jung, Commerce, CA (US)

(73) Assignee: PRIMA USA TRAVEL INC, Commerce, CA (US)

( * ) Notice: Subject to any disclaimer, the term of this patent is extended or adjusted under 35 U.S.C. 154(b) by 338 days.

(21) Appl. No.: 16/438,832

(22) Filed: Jun. 12, 2019

(65) Prior Publication Data

US 2020/0390210 A1 Dec. 17, 2020

(51) Int. Cl.

| | |
|---|---|
| ***A45C 13/02*** | (2006.01) |
| ***B65D 81/113*** | (2006.01) |
| ***A45C 5/03*** | (2006.01) |
| ***A45C 5/14*** | (2006.01) |
| ***A45C 13/30*** | (2006.01) |

(52) U.S. Cl.

CPC ..... *A45C 13/02* (2013.01); *A45C 5/03* (2013.01); *A45C 5/14* (2013.01); *A45C 13/30* (2013.01); *B65D 81/113* (2013.01); *A45C 2005/037* (2013.01); *A45C 2013/026* (2013.01)

(58) Field of Classification Search

CPC .. A45C 13/02; A45C 5/03; A45C 5/14; A45C 13/30; A45C 2005/037; A45C 2013/026; B65D 81/113

See application file for complete search history.

(56) References Cited

U.S. PATENT DOCUMENTS

| | | | | |
|---|---|---|---|---|
| 4,106,597 | A * | 8/1978 | Shook | A45C 11/20 190/110 |
| D263,176 | S | 3/1982 | Harrington | |
| D266,147 | S | 9/1982 | McIntosh et al. | |
| D280,976 | S | 10/1985 | Diamond | |
| 6,588,595 | B2 * | 7/2003 | Levin | B65B 55/20 206/523 |
| 6,779,665 | B2 | 8/2004 | Bolanos | |
| D636,676 | S | 4/2011 | Gebbia | |
| 8,365,886 | B2 * | 2/2013 | Mehta | A45C 5/14 190/18 A |
| D723,279 | S | 3/2015 | Wax | |
| D746,061 | S | 12/2015 | Wax | |
| D746,595 | S | 1/2016 | Wax | |
| D752,346 | S | 3/2016 | Wax | |

(Continued)

*Primary Examiner* — Tri M Mai

(74) *Attorney, Agent, or Firm* — Innovation Capital Law Group, LLP; Vic Lin

(57) ABSTRACT

A container, such as a suitcase, can be used to safely and securely transport bottles, such as wine bottles. The suitcase can open about a central longitudinal axis to provide top open suitcase halves, where one or both of the halves can include a foam insert with receptacles for the placement of bottles therein. The foam can support and separate the bottles so that breakage is minimized or eliminated during transport. A lid, a strap, or both, may be provided to cover at least the receptacles. In some cases, a tunnel may be formed into the foam, extending from one end of the receptacle, for insertion of a neck portion of the bottle therein, thereby further supporting the bottle in the foam. The foam can fit snugly into each half of the suitcase and the number of bottles may be dependent upon user needs and/or size of the suitcase.

19 Claims, 11 Drawing Sheets

(56) References Cited

U.S. PATENT DOCUMENTS

| | | | | |
|---|---|---|---|---|
| D796,204 | S | 9/2017 | Wax | |
| 9,913,523 | B1 * | 3/2018 | Contag | A45D 29/20 |
| D857,393 | S | 8/2019 | Wax | |
| D863,954 | S | 10/2019 | Eckart et al. | |
| 2009/0050429 | A1 | 2/2009 | Adams | |
| 2015/0047941 | A1 | 2/2015 | Wax | |
| 2015/0150348 | A1 * | 6/2015 | Wax | A45C 5/03<br>190/18 A |
| 2018/0153281 | A1 | 6/2018 | Contag | |
| 2019/0373993 | A1 | 12/2019 | Wax | |
| 2020/0221842 | A1 | 7/2020 | Navarrete | |

* cited by examiner

SUITCASE FOR TRANSPORTING BOTTLES

BACKGROUND OF THE INVENTION

1. Field of the Invention

Embodiments of the invention relates generally to suitcases. More particularly, the invention relates to a suitcase having a plurality of compartments for safely disposing bottles for transportation.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

When traveling, should one purchase or otherwise acquire bottles of a liquid, such as bottles of wine, for example, the traveler must be carefully to properly pack and secure the bottle so that breakage is prevented. Such can be especially difficult when multiple bottles of wine are needed to be secured for transportation.

Conventionally, when traveling by air, the traveler can wrap the bottles in a protective packaging, such as bubble wrap and attempt to place the bottles in their suitcase, often protected by clothing, for example. However, a suitcase may be handled roughly during travel and even the best packed bottles may break as a result.

In view of the foregoing, there is a need for improved apparatus for packing and securing bottles, such as wine bottles, for a traveler.

SUMMARY OF THE INVENTION

Embodiments of the present invention provide a suitcase comprising an outer shell openable to provide access to an interior thereof; at least one insert disposed in at least a portion of the interior of the outer shell; a plurality of compartments formed in the at least one insert, the plurality of compartments accessible from a top portion of the at least one insert, wherein a portion of the at least one insert forms an inner surface of the plurality of compartments; and a tunnel formed in one end of each of the plurality of compartments, the tunnel communicating with each of the plurality of compartments and extending into the at least one insert.

Embodiments of the present invention further provide a suitcase comprising an outer shell openable to provide access to an interior thereof; at least one insert disposed in at least a portion of the interior of the outer shell; a plurality of compartments formed in the at least one insert, the plurality of compartments accessible from a top portion of the at least one insert, wherein a portion of the at least one insert forms an inner surface of the plurality of compartments; and a cover fitting over each of the at least one insert, the cover configured to secure a bottle in each of the plurality of compartments when the suitcase is in a closed configuration.

Embodiments of the present invention also provide a suitcase comprising an outer shell openable to provide access to an interior thereof; at least one insert disposed in at least a portion of the interior of the outer shell; a plurality of compartments formed in the at least one insert, the plurality of compartments accessible from a top portion of the at least one insert, wherein a portion of the at least one insert forms an inner surface of the plurality of compartments; and at least one interior strap extending across a top surface of each of the at least one insert, each of the at least one interior strap selectively openable to permit access to each of the plurality of compartments and closable to prevent bottles disposed in the plurality of compartments from inadvertently falling out thereof.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
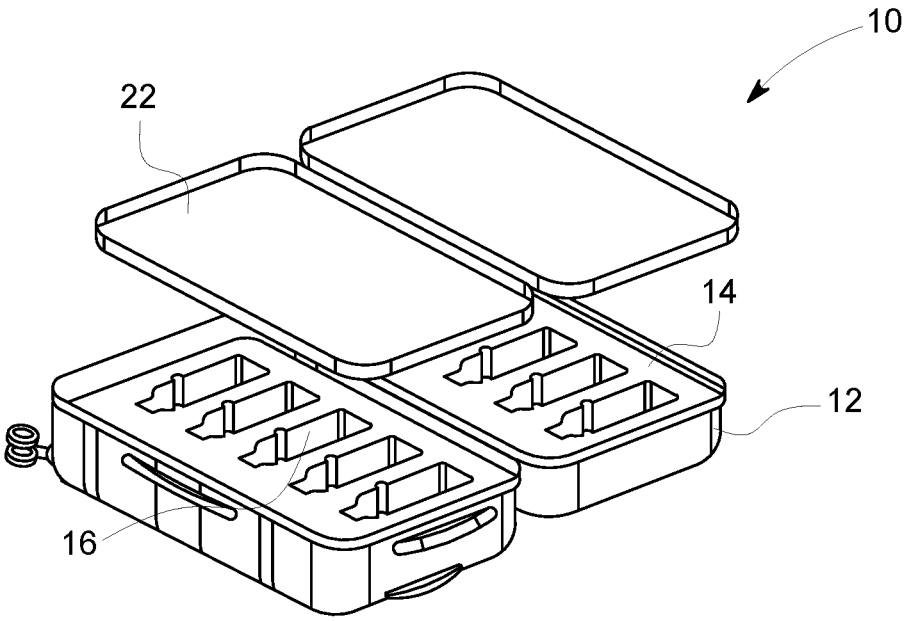
FIG. 1 illustrates a perspective view of a bottle transport suitcase according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any device, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a container, such as a suitcase, that can be used to safely and securely transport bottles, such as wine bottles. The suitcase can have an exterior resembling a conventional suitcase and may include a retractable handle, wheels and the like. The suitcase can open about a central longitudinal axis to provide top open suitcase halves, where one or both of the halves can include a foam insert with receptacles for the placement of bottles therein. The foam can support and separate the bottles so that breakage is minimized or eliminated during transport. A lid, a strap, or both, may be provided to cover at least the receptacles. In some cases, a tunnel may be formed into the foam, extending from one end of the receptacle, for insertion of a neck portion of the bottle therein, thereby further supporting the bottle in the foam. The foam can fit snugly into each half of the suitcase and the number of bottles may be dependent upon user needs and/or size of the suitcase.

Figure 2:
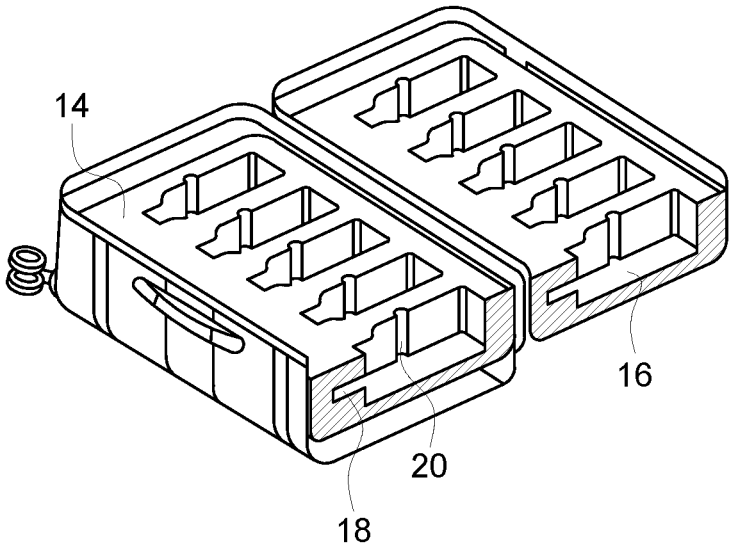
FIG. 2 illustrates a cross-sectional view of the bottle transport suitcase of FIG. 1, with the cover removed for clarity.

Referring to FIGS. 1 and 2, a suitcase 10 can include an outer shell 12 having an insert 14 disposed therein. The insert 14 may include a plurality of receptacles 16 formed therein. The receptacles may be open at a top portion of the insert and may extend into the insert 14 without reaching a bottom portion thereof. In other words, the material of the insert 14 may surround the receptacle 16, except for the open top portion thereof. A notch 20 along one side of each of the receptacles 16 to provide a finger insert to assist in retrieving a bottle disposed in the receptacle 16. A cover 22 (also referred to as lid 22) may be disposable over the insert 14, covering the receptacles 16. A tunnel 18 may extend from the receptacle 16, as shown in FIG. 2, where the tunnel 18 may be configured and located to receive a neck of a bottle, as described in greater detail below. The tunnel 18 can be formed in one end of each of the plurality of compartments (receptacles 16), the tunnel communicating with each of the plurality of compartments and extending into the at least one insert 14.

Figure 3:
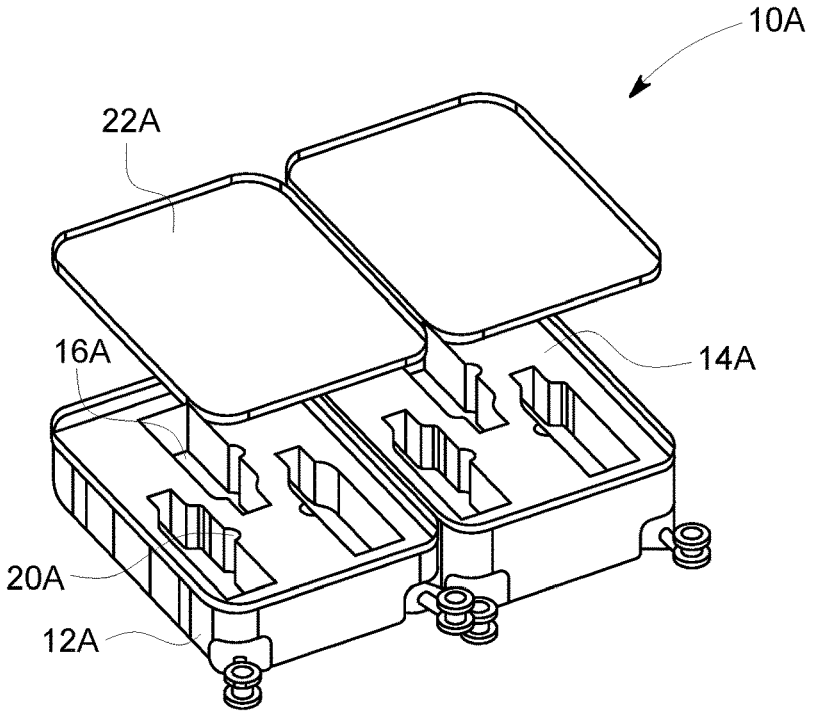
FIG. 3 illustrates a perspective view of a bottle transport suitcase according to another exemplary embodiment of the present invention.
Figure 4:
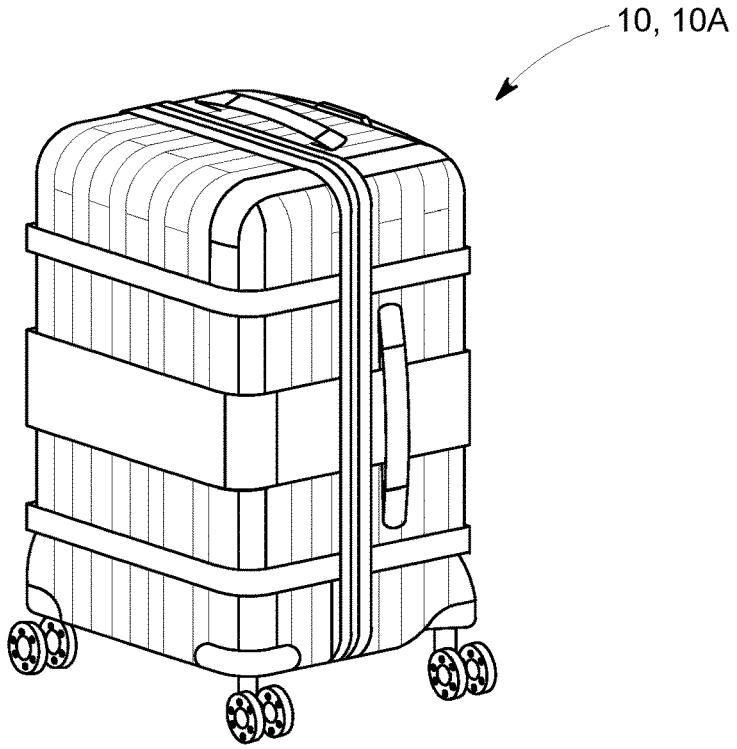
FIG. 4 illustrates a perspective view of the bottle transport suitcase of FIG. 1 or 3, in a closed configuration.
Figure 5:
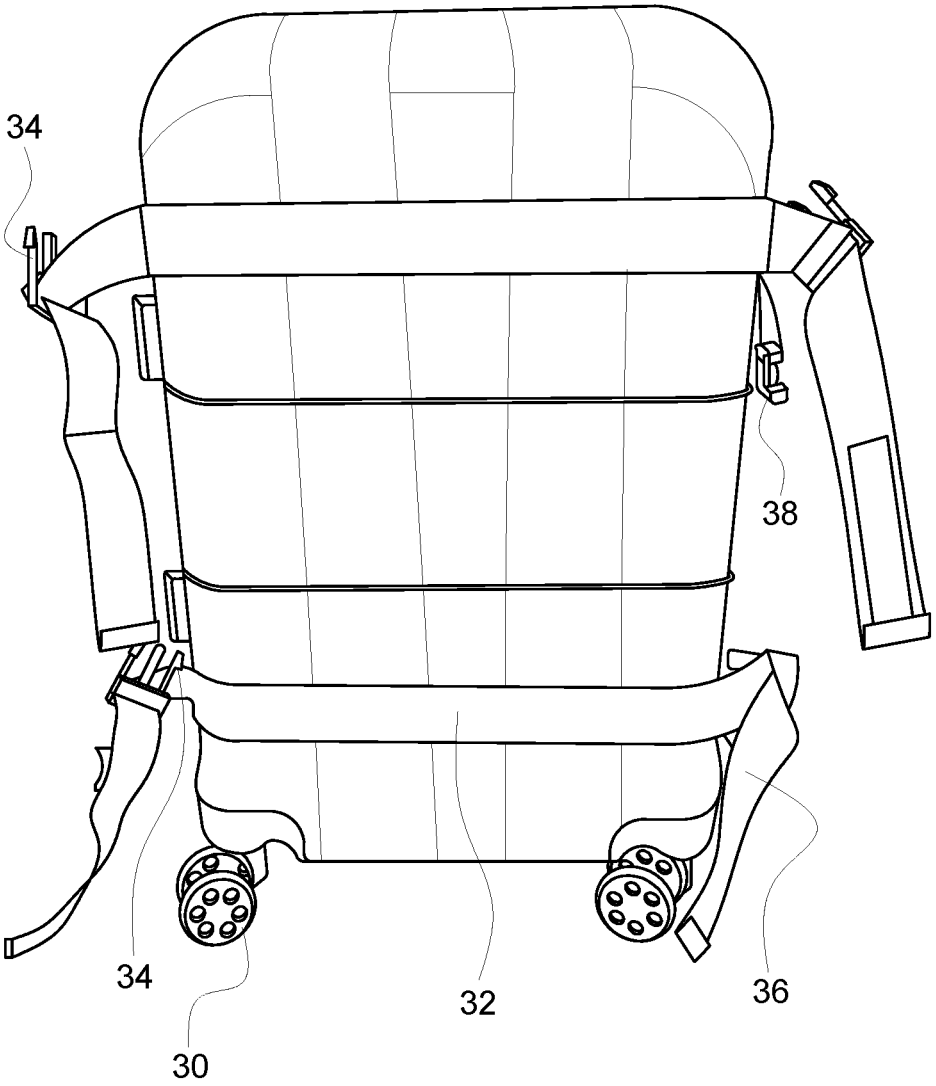
FIG. 5 illustrates a back view of the closed bottle transport suitcase of FIG. 4.
Figure 6:
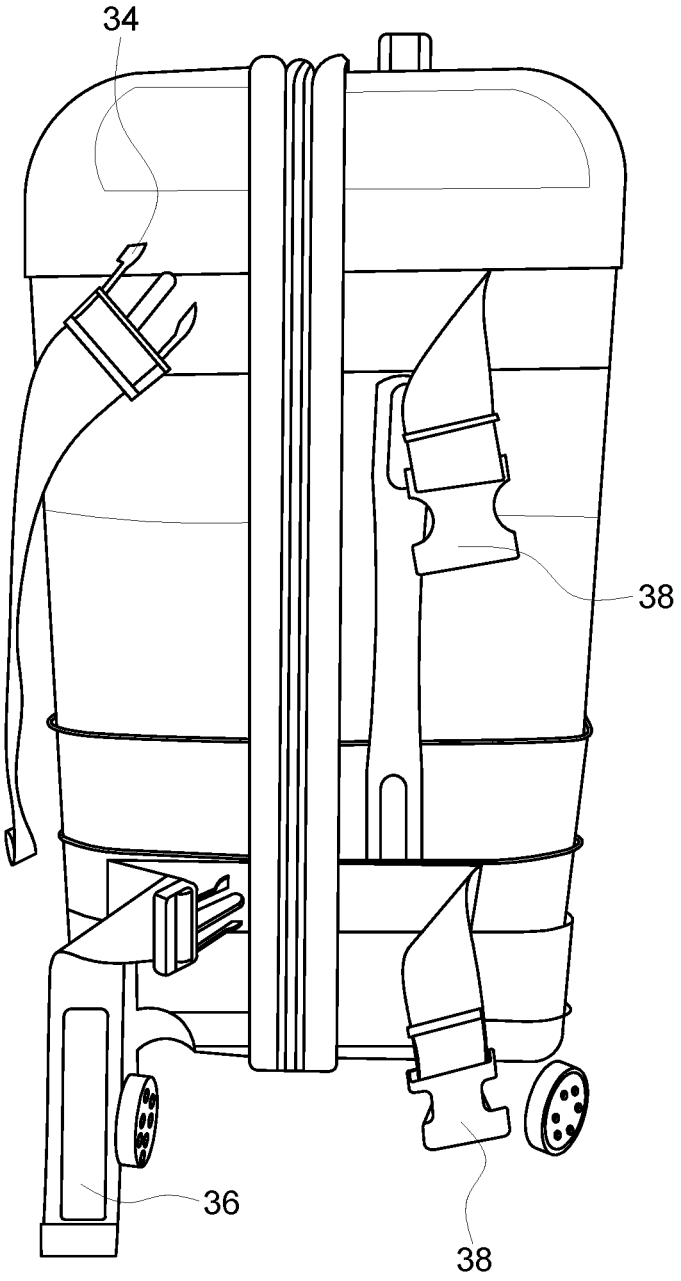
FIG. 6 illustrates a side view of the closed bottle transport suitcase of FIG. 4.

Referring now to FIG. 3, another embodiment of a suitcase 10A can include an outer shell 12A with an insert 14A disposed therein. The insert 14A may include a plurality of receptacles 16A formed therein. The receptacles 16A may be similar to the receptacles 16, discussed above. The receptacles 16A can include a notch 20A similar to notch 20, discussed above. A cover 22A may be disposable over the insert 14A. The suitcase 10A may be similar to suitcase 10, except for the size thereof, and the locations of the receptacles formed in the inserts.

The suitcase 10, 10A may be formed in various sizes and shapes. In some embodiments, the suitcase 10 may be configured with a length of about 26 inches, while the suitcase 10A may be configured with a length of about 24 inches. It should be understood that such dimensions are exemplary and the suitcase 10, 10A may be designed in any size or shape depending on user desires or the particular application.

As shown in FIGS. 1 through 3, the suitcase 10, 10A may open along a central longitudinal axis to form two halves having approximately the same size (or approximately the same interior volume). In this embodiment, both halves may include the insert 14, 14A so that bottles may be stored in the receptacles 16, 16A in each half. In some embodiments, the suitcase may include one half with the insert 14, 14A, with the other half open for clothes or other such items. In other embodiments, the suitcase may open to form two halves where one half has a volume different from the other half. In such embodiments, one or both halves may include the inserts 14, 14A, depending on application, suitcase size, user preference, or the like.

Referring to FIGS. 4 through 7, views of an exterior of the suitcase 10, 10A are shown. The suitcase 10, 10A may be supported by a plurality of wheels 30, as may be known in the art. One or more straps 32 may extend about the case to retain the suitcase 10, 10A in a closed configuration when the straps 32 are connected. A male connector 34 may be disposed on one end of the strap 32 and a female connector 38 may be disposed on another end of the strap 32, where the male and female connectors 34, 38 may connect to complete a loop about the suitcase 10, 10A. An end 36 of the strap 32 may be pulled to tighten the strap 32 about the suitcase 10, 10A. Other connectors may be used in place of the male and female connectors shown in the Figures. For example, a hook and loop fastener may be used, or other connector types may be used to secure ends of the strap together.

Figure 7:
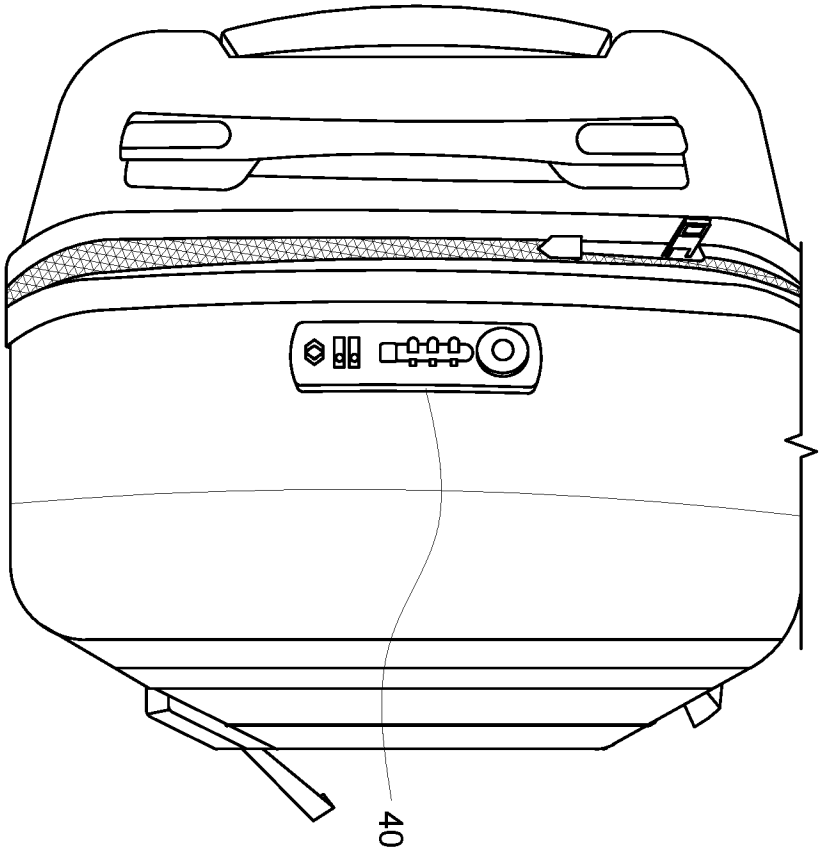
FIG. 7 illustrates a top view of the closed bottle transport suitcase of FIG. 4.
Figure 8:
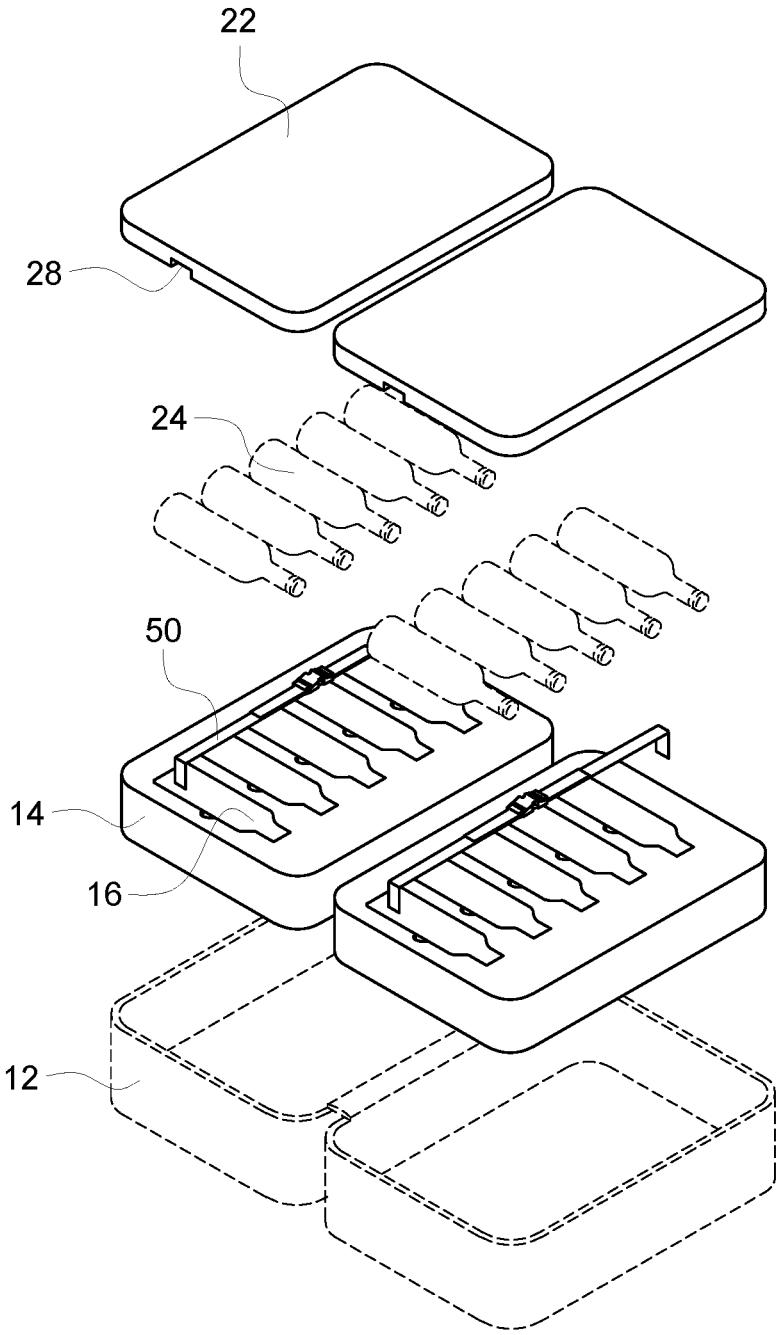
FIG. 8 illustrates an exploded perspective view of the bottle transport suitcase of FIG. 1.
Figure 9:
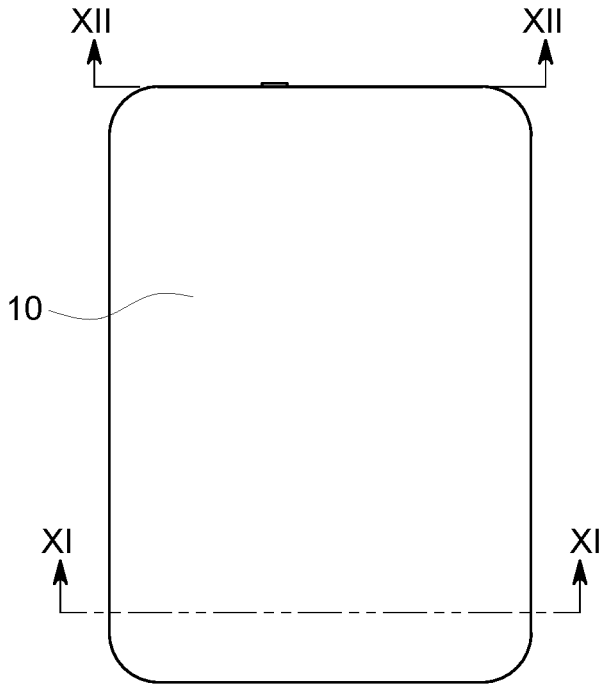
FIG. 9 illustrates a top view of one-half of the bottle transport suitcase of FIG. 1, with the cover in place and bottles stored therein.
Figure 10:
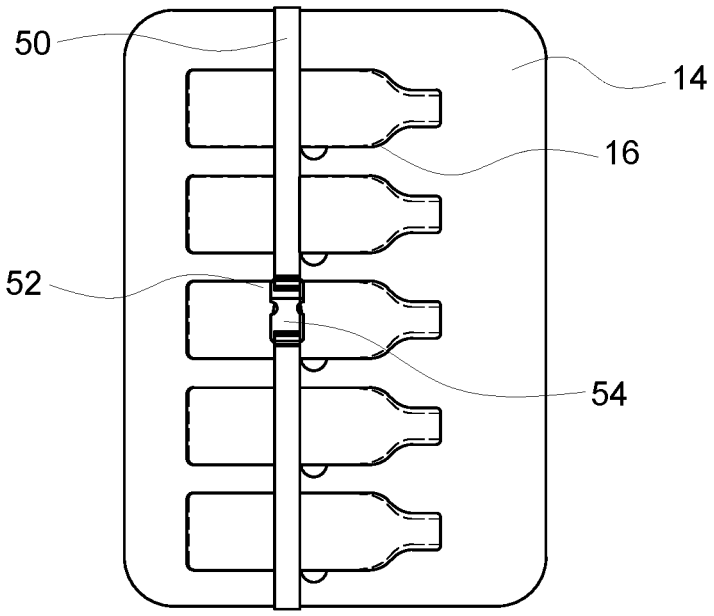
FIG. 10 illustrates a top view of the bottle transport suitcase of FIG. 1, with the cover removed.

As shown in FIG. 7, a lock mechanism 40 may be used to keep the suitcase 10, 10A in a locked configuration, preventing a user from accessing an interior thereof. The lock mechanism 40 may be any case locking design known in the art and may be engaged with a key, with rotating number and/or letter dials, or the like.

Referring now to FIGS. 8 through 12, the suitcase of FIG. 1 is shown in greater detail. A plurality of bottles 24 may be placed into the receptacles 16. In some embodiments, a tunnel 18 may receive a neck 26 of the bottle 24.

Figure 11:
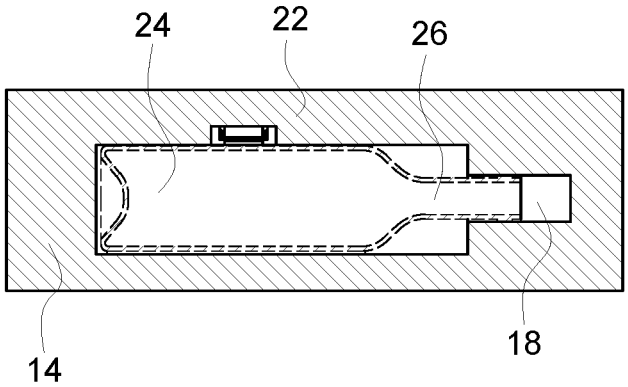
FIG. 11 illustrates a cross-sectional view taken along line XI-XI of FIG. 9.
Figure 12:
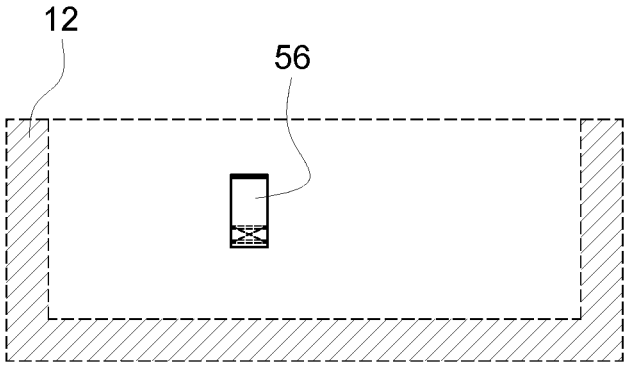
FIG. 12 illustrates a cross-sectional view taken along line XII-XII of FIG. 9.
Figure 13:
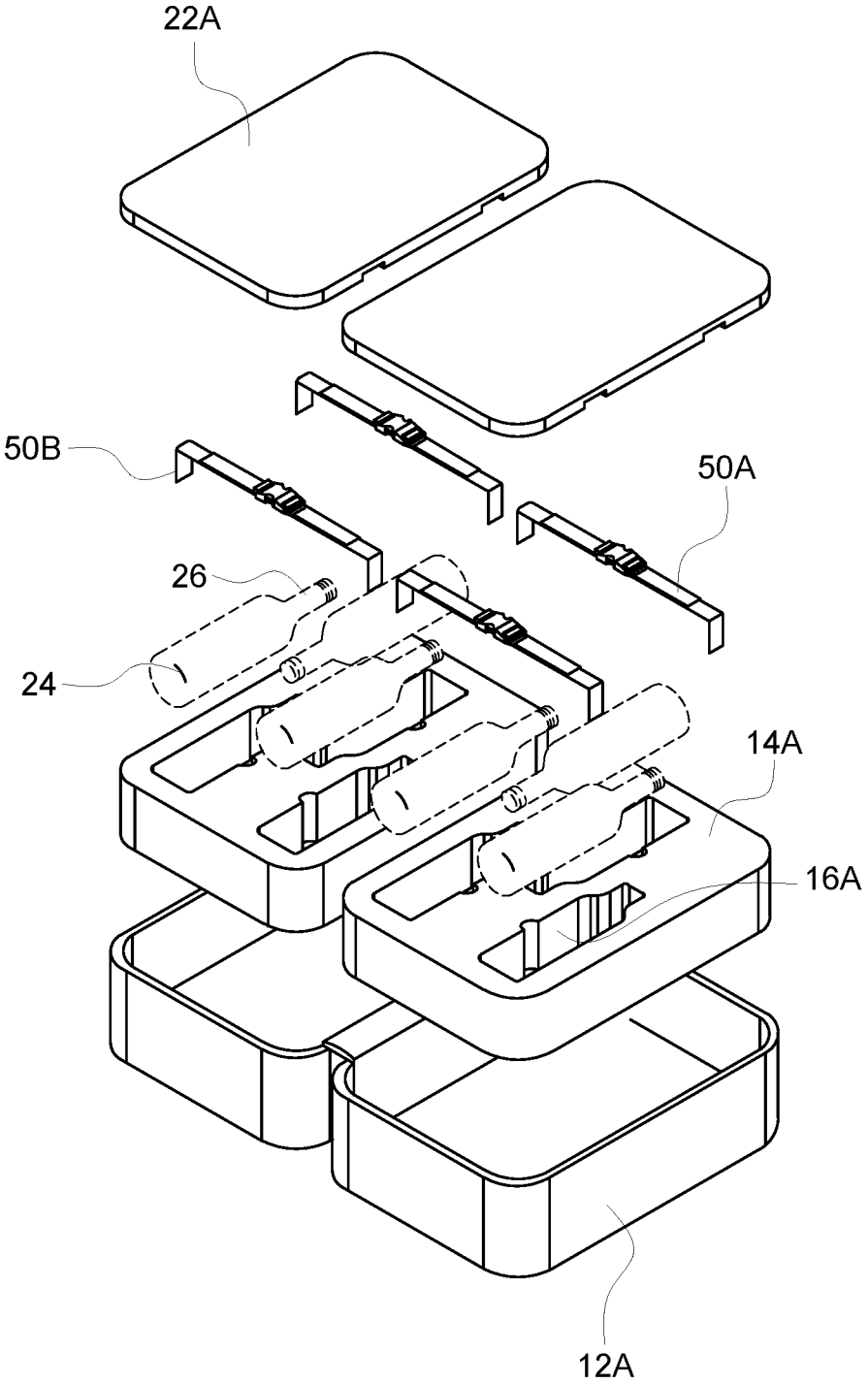
FIG. 13 illustrates an exploded perspective view of the bottle transport suitcase of FIG. 3.
Figure 14:
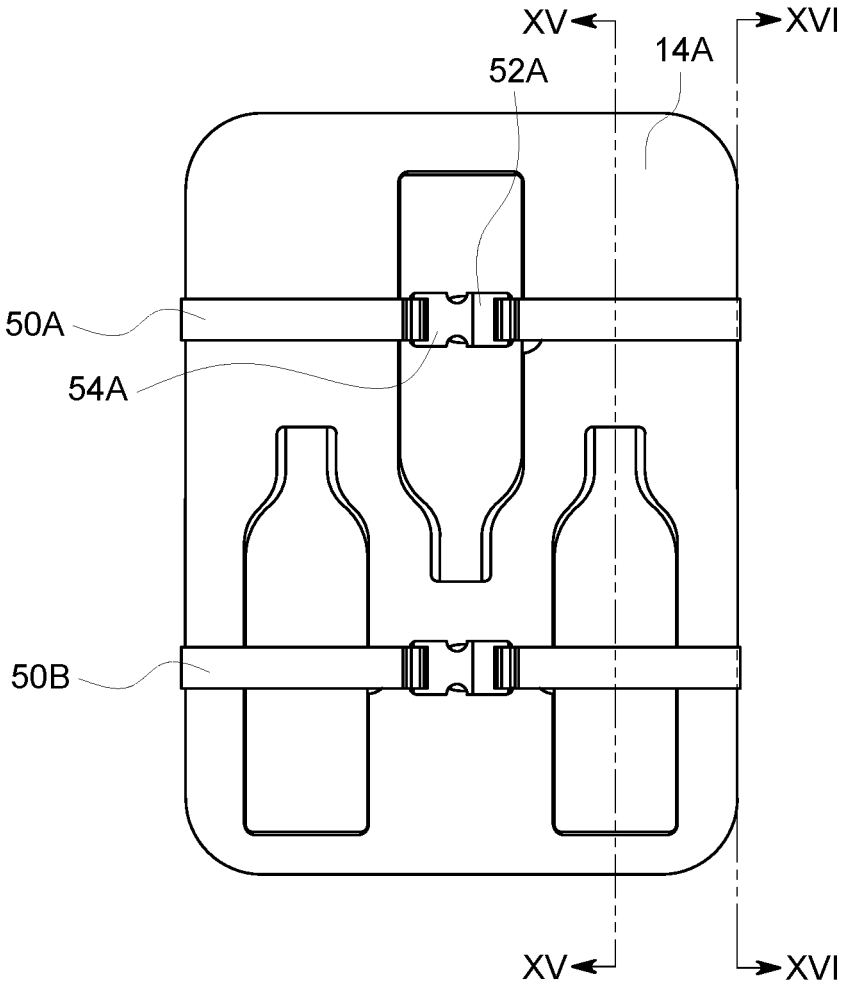
FIG. 14 illustrates a top view of one-half of the bottle transport suitcase of FIG. 13.
Figure 15:
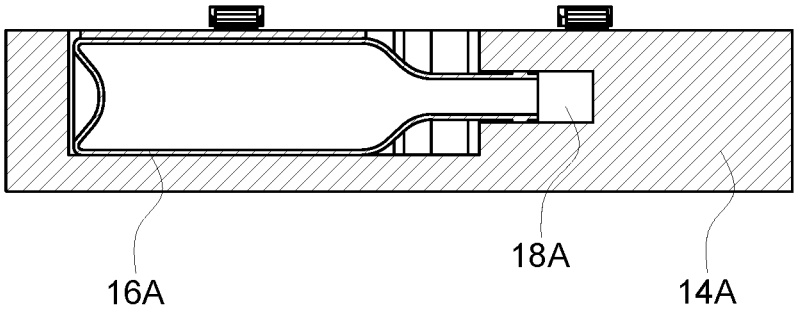
FIG. 15 illustrates a cross-sectional view taken along line XV-XV of FIG. 14.
Figure 16:
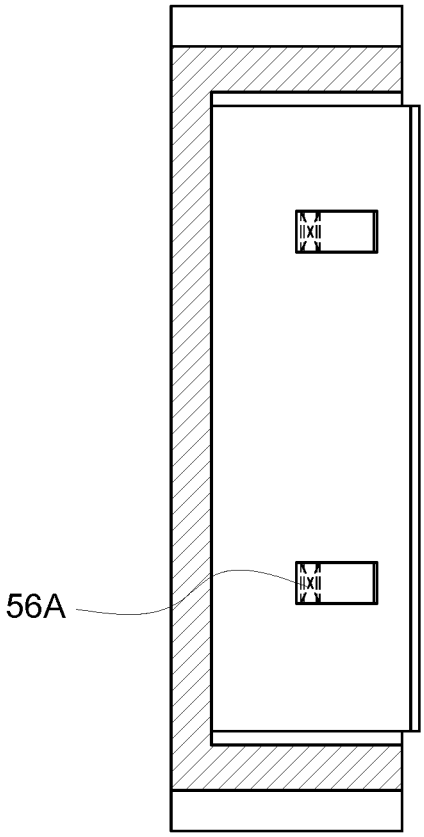
FIG. 16 illustrates a cross-sectional view taken along line XVI-XVI of FIG. 14.

One or more interior straps 50 (one interior strap 50 is shown in this embodiment, but more than one may be used as desired) may extend across the top of the insert 14, where the cover 22 may include a notch 28 for receiving the strap, where the remainder of the cover 22 may be disposed directly on top of the insert 14, as best seen in FIG. 11. The strap 50 may include a secured end 56 that may be secured to an inside of the shell 12 of the suitcase 10. The strap 50 can include ends 52, 54 that may removably connect to holds ends of the strap 50 together.

Referring now to FIGS. 13 through 16, the suitcase 10A of FIG. 3 is shown in greater detail. A plurality of bottles 24 may be placed into the receptacles 16A. In some embodiments, a tunnel 18A may receive a neck 26 of the bottle 24.

Like the embodiment of FIGS. 8 through 12, one or more interior straps 50A (two interior straps 50A, 50B are shown in this embodiment, but a single strap or more than two straps may be used as desired) may extend across the top of the insert 14A, where the cover 22A may include notches for receiving the straps 50A, where the remainder of the cover 22A may be disposed directly on top of the insert 14A. The straps 50A may include a secured end 56A that may be secured to an inside of the shell 12A of the suitcase 10A. The straps 50A can include ends 52A, 54A that may removably connect to holds ends of the straps 50A together.

In some embodiments, the insert 14, 14A may be a foam insert. More specifically, in exemplary embodiments, the insert 14, 14A may be a mold injected foam material designed to fit perfectly in the shell 12, 12A of the suitcase 10, 10A. In some embodiments, the insert 14, 14A may be formed integrally with the shell 12, 12A, whereas, in other embodiments, the insert 14, 14A may be removable from the shell 12, 12A.

The receptacles 16, 16A are shown being designed to hold bottles, such as wine bottles. Of course, embodiments of the present invention may include receptacles 16, 16A that are sized and shaped to hold other bottles that a user may desire to ship or transport. While the Figures show all the receptacles 16, 16A being the same size, in some embodiments, a single suitcase 10, 10A may include receptacles 16, 16A having different sizes. Typically, the receptacles 16, 16A may be sized to frictionally fit a bottle therein. In some embodiments, the receptacle of the insert may resiliently deform to press against the bottle fit therein.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a sub combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A suitcase comprising:

an outer shell openable along a central longitudinal portion to provide access to a first interior volume and a second interior volume of an interior thereof;

at least one insert disposed in at least one of the first interior volume and the second interior volume;

a plurality of compartments formed in the at least one insert, the plurality of compartments accessible from a top portion of the at least one insert, wherein a portion of the at least one insert forms an inner surface of each of the plurality of compartments;

a tunnel formed in one end of each of the plurality of compartments, the tunnel communicating with each of the plurality of compartments and extending into the at least one insert, the tunnel surrounded on all sides by the at least one insert except for a tunnel opening communicating with each of the plurality of compartments; and a cover fitting over each of the at least one insert, the cover configured to secure a bottle in each of the plurality of compartments when the suitcase is in a closed configuration.

2. The suitcase of claim 1, further comprising at least one interior strap extending across a top surface of each of the at least one insert, each of the at least one interior strap selectively openable to permit access to each of the plurality of compartments and closable to prevent bottles disposed in the plurality of compartments from inadvertently falling out thereof.

3. The suitcase of claim 2, wherein ends of each of the at least one interior strap is secured to an inner surface of the outer shell of the suitcase.

4. The suitcase of claim 2, further comprising a cover fitting over each of the at least one insert, the cover configured to secure a bottle in each of the plurality of compartments when the suitcase is in a closed configuration, the cover includes one or more slots for receiving each of the at least one interior strap therein.

5. The suitcase of claim 1, further comprising a finger notch formed along at least one side of each of the plurality of compartments.

6. The suitcase of claim 1, wherein the at least one insert is formed from a foam material.

7. The suitcase of claim 1, wherein the at least one insert is mold injected foam applied directly into the outer shell.

8. The suitcase of claim 1, wherein the outer shell opens about the longitudinally central portion to form two halves when in an open configuration.

9. The suitcase of claim 8, wherein each of the two halves have one of the at least one inserts therein.

10. A suitcase comprising:

an outer shell openable to provide access to an interior thereof;

at least one insert disposed in at least a portion of the interior of the outer shell;

a plurality of compartments formed in the at least one insert, the plurality of compartments accessible from a top portion of the at least one insert, wherein a portion of the at least one insert forms an inner surface of each of the plurality of compartments;

a tunnel formed in one end of each of the plurality of compartments, the tunnel communicating with each of the plurality of compartments and extending into the at least one insert, the tunnel surrounded on all sides by the at least one insert except for a tunnel opening communicating with each of the plurality of compartments; and a cover fitting over each of the at least one insert, the cover configured to secure a bottle in each of the plurality of compartments when the suitcase is in a closed configuration.

11. The suitcase of claim 10, further comprising at least one interior strap extending across a top surface of each of the at least one insert, each of the at least one interior strap selectively openable to permit access to each of the plurality of compartments and closable to prevent bottles disposed in the plurality of compartments from inadvertently falling out thereof.

12. The suitcase of claim 11, wherein ends of each of the at least one interior strap is secured to an inner surface of the outer shell of the suitcase.

13. The suitcase of claim 10, wherein the at least one insert is formed from a foam material.

14. The suitcase of claim 10, wherein the at least one insert is mold injected foam applied directly into the outer shell.

15. The suitcase of claim 10, wherein the outer shell opens about a longitudinally central portion to form two halves when in an open configuration, wherein each of the two halves have one of the at least one inserts therein.

16. A suitcase comprising:

an outer shell openable to provide access to an interior thereof;

at least one insert disposed in at least a portion of the interior of the outer shell;

a plurality of compartments formed in the at least one insert, the plurality of compartments accessible from a top portion of the at least one insert, wherein a portion of the at least one insert forms an inner surface of each of the plurality of compartments;

a tunnel formed in one end of each of the plurality of compartments, the tunnel communicating with each of the plurality of compartments and extending into the at least one insert, the tunnel surrounded on all sides by the at least one insert except for a tunnel opening communicating with each of the plurality of compartments; and at least one interior strap extending across a top surface of each of the at least one insert, each of the at least one interior strap selectively openable to permit access to each of the plurality of compartments and closable to prevent bottles disposed in the plurality of compartments from inadvertently falling out thereof.

17. The suitcase of claim 16, wherein ends of each of the at least one interior strap is secured to an inner surface of the outer shell of the suitcase.

18. The suitcase of claim 16, wherein the at least one insert is formed from a foam material.

19. The suitcase of claim 16, wherein the outer shell opens about a longitudinally central portion to form two halves when in an open configuration, wherein each of the two halves have one of the at least one inserts therein.

* * * * *